United States Patent [19]

Melcher et al.

[11] 3,948,139

[45] Apr. 6, 1976

[54] ELECTRONIC SYNTHESIZER WITH VARIABLE/PRESET VOICE CONTROL

[75] Inventors: Byron Melcher, Arlington Heights, Ill.; Alden J. Carlson, Edmonds, Wash.

[73] Assignee: Warwick Electronics Inc., Chicago, Ill.

[22] Filed: Aug. 28, 1974

[21] Appl. No.: 501,200

[52] U.S. Cl. ..... 84/1.19; 84/1.11; 84/1.13; 84/1.25; 84/1.26; 84/DIG. 9; 84/DIG. 20

[51] Int. Cl.[2] ..... G10H 1/04; G10H 5/02

[58] Field of Search ..... 84/1.01, 1.11–1.13, 84/1.19–1.26, DIG. 2, DIG. 9, DIG. 20

[56] References Cited

UNITED STATES PATENTS

| | | | |
|---|---|---|---|
| 3,479,440 | 11/1969 | Martin et al. | 84/1.25 |
| 3,490,327 | 1/1970 | Volpe | 84/1.25 |
| 3,493,669 | 2/1970 | Elbrecht et al. | 84/1.25 X |
| 3,510,565 | 5/1970 | Morez | 84/1.24 X |
| 3,519,720 | 7/1970 | Bunger | 84/1.12 |
| 3,544,694 | 12/1970 | Freeman | 84/1.11 |
| 3,590,133 | 6/1971 | Schwartz et al. | 84/1.24 |
| 3,591,699 | 7/1971 | Cutler | 84/1.11 |
| 3,591,700 | 7/1971 | Neubauer et al. | 84/1.24 |
| 3,604,829 | 9/1971 | Bunger | 84/1.19 |

*Primary Examiner*—L. T. Hix
*Assistant Examiner*—Stanley J. Witkowski
*Attorney, Agent, or Firm*—Wegner, Stellman, McCord, Wiles & Wood

[57] ABSTRACT

An electronic musical synthesizer generates tone signals coupled to a controllable bandpass filter and a controllable low-pass filter. A plurality of voice switches are individually selectable to couple preset control voltages to the filters, and to enable potentiometers which can be adjusted to generate control voltages to vary the frequency characteristics of the filters, control the octave of the tone signals, and to control a modulation oscillator. When a variable/preset switch is set to a preset state, the potentiometers are disconnected and auxiliary sections of the selected voice switch presets voltages for the oscillator, the octave circuit and the filters.

22 Claims, 3 Drawing Figures

TREMOLO OSCILLATOR
SINE OUT
SQUARE OUT
SIN
SQ
DEPTH
PITCH
+9v
-9v
RATE
TREM.
VIB.
GLIDE SWITCH
OCTAVE 1
ISOLATION AMP
SAMPLE AND HOLD
GLIDE CONTROL
KEYBOARD FREQUENCY
D.C. SUMMER
SAMPLE TRIGGER
D.C. KEYDOWN DETECTOR
A.C. KEYDOWN DETECTOR
ONE SHOT
GATE
KEYDOWN TRIGGER PULSES
BIAS SUPPLY
KEYBOARD

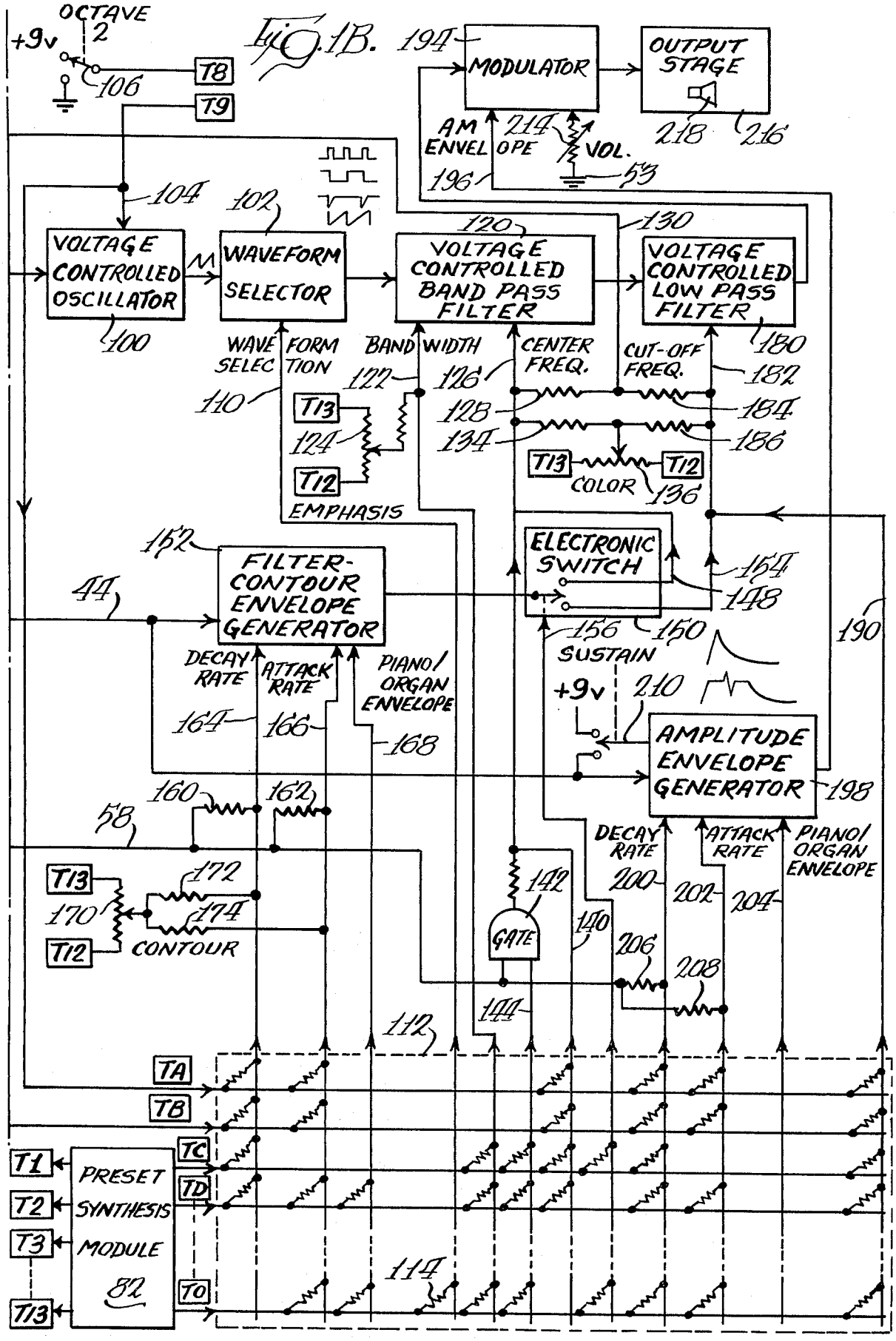
Fig. 1B.
OCTAVE
2
+9v
106
T8
T9
194
MODULATOR
OUTPUT STAGE
218
216
AM ENVELOPE
214
VOL.
53
196
104
102
120
130
VOLTAGE CONTROLLED OSCILLATOR
WAVEFORM SELECTOR
VOLTAGE CONTROLLED BAND PASS FILTER
VOLTAGE CONTROLLED LOW PASS FILTER
100
180
WAVE FORM SELECTION
BAND WIDTH
CENTER FREQ.
CUT-OFF FREQ.
110
122
126
182
128
184
134
186
T13
124
T12
EMPHASIS
T13
T12
COLOR
136
152
FILTER-CONTOUR ENVELOPE GENERATOR
ELECTRONIC SWITCH
154
148
44
156
150
190
SUSTAIN
DECAY RATE
ATTACK RATE
PIANO/ ORGAN ENVELOPE
+9v
210
164
166
168
AMPLITUDE ENVELOPE GENERATOR
198
160
162
58
DECAY RATE
ATTACK RATE
PIANO/ ORGAN ENVELOPE
T13
172
142
200
202
204
170
174
T12
CONTOUR
GATE
140
206
208
144
112
TA
TB
TC
TD
TO
T1
T2
T3
T13
PRESET SYNTHESIS MODULE
82
114

82

ELECTRONIC SYNTHESIZER WITH VARIABLE/PRESET VOICE CONTROL

BACKGROUND OF THE INVENTION

This invention relates to an electronic musical synthesizer having a preset circuit for disabling variable controls and enabling preset controls for filters, octave circuits and vibrato circuits.

Electronic musical synthesizers differ from electronic organs in that they include electronically tunable filters which change the harmonic content, or timbre, of the voice being artifically produced. Typically, the controllable filters comprise in cascade a bandpass filter, in which the bandwidth and center frequency are controllable, and a low-pass filter, in which the cut-off frequency is controllable. The tuning of these filters is changed continuously during the progression of a single tone, from its initiation to its decay. As a result, the sound emitted from the synthesizer speaker, during the time duration of a tone, is different from the sound produced when the tone was first initiated, unlike an electronic organ in which the tone remains continuous for any given voicing.

The timbre of the synthesizer voice is controlled by several variable devices which alter the frequency characteristics of the controllable filters. A variable Emphasis control changes the Q or bandwidth of the bandpass filter. A variable Color control changes the average amount of high harmonic content which is passed by the tunable filters, by changing the center frequency of the bandpass filter and the cut-off frequency of the low-pass filter. A variable Contour control changes the rate at which timbre is changed, or the amount of tuning change of the filters per unit of time. This is accomplished by adjusting the attack rate and decay rate of a contour envelope generator which controls either the center frequency adjustment for the bandpass filter, or the cut-off frequency adjustment for the low-pass filter.

An oscillator in the synthesizer generates an alternating or modulation signal, having a rate of frequency adjusted by a rate control, and a depth or amplitude adjustable by a depth control. A vibrato channel couples the oscillator to a tone combining circuit to create a vibrato effect in similar fashion as in an electronic organ, in that the alternating signal varies the frequency of the basic tone being generated. Unlike an electronic organ, in which tremolo is an amplitude change of tone, a synthesizer tremolo effect relates to a frequency spectrum change. The synthesizer tremolo channel couples the oscillator to the Color control portion of the synthesizer.

By adjusting these frequency related controls, the operator of an electronic musical synthesizer can accomplish a great variety of novel musical effects not possible with conventional musical devices. In addition, the operator can imitate known musical instruments more closely than is possible with other types of electronic instruments. Because it is difficult foro an inexperienced operator to arrange these controls in the precise manner necessary to imitate well-known instruments, it has been conventional to provide a switching circuit with voicing tabs for each musical instrument to be imitated. upon selecting a particular musical instrument by depressing the associated tab switch, a resistor matrix passes preset control voltages to the controllable filter.

However, such preset control voltages can be altered by the setting of the various frequency related controls described above. While the ability to alter is desirable to an experienced operator, in order to create unique variations upon known instruments, it is very difficult for an inexperienced operator to set all of the frequency related controls to a null position when attempting to simulate a known instrument. The presence of several controls, each of which must be moved to a zero setting, and proper setting of the octave controls and other adjustable devices present an overwhelming number of variations to an inexperienced operator. In addition, slippage in the mechanical linkage for the knobs, slides and switches, backlash have made it difficult to ensure optimum simulation of well-known instruments unless the operator has an experienced ear for detecting minor variations which can occur inadvertantly.

SUMMARY OF THE INVENTION

In accordance with the present invention, a unique variable/preset circuit creates precise imitation of known instruments, when desired, while also allowing minor or major variations on known instruments, when desired. A variable/preset switch in a preset synthesis module has a variable state which duplicates prior musical synthesizers in that any of the adjustable controls can be varied to alter certain preset frequency characteristics of the filter. Frequency related controls such as Color, Emphasis, and Contour can be adjusted or nulled, as desired by the operator. When well-known instruments are to be precisely duplicated (within the ability of the synthesizer), a preset state is selected in which all frequency related controls are effectively disconnected from the circuit. If an amplitude change of spectrum is characteristic of the instrument being duplicated, a synthesizer tremolo signal of predetermined rate and depth is coupled to the filters. In addition, if a vibrato effect is characteristic of the instrument being duplicated, a vibrato signal of predetermined rate and depth modulates the primary tone. The octave range of the tone is also automatically controlled by the preset circuit. Thus, the voicing necessary to simulate well-known instruments may be automatically preset to achieve precise voicing within the ability of the synthesizer.

One object of the present invention is the provision of an electronic musical synthesizer having a preset circuit for effectively disabling frequency controls for controllable filters in the synthesizer.

Another object of the present invention is the provision in an electronic musical instrument, either of the synthesizer or organ type, of a preset circuit in which the vibrato control can be effectively disabled and replaced with a vibrato effect of preset rate and depth, and in which the octave settings of the instrument as well as other settings can be automatically preset.

Other features and advantages of the invention will be apparent from the following description, and from the drawings. While an illustrative embodiment of the invention is shown in the drawings and will be described in detail herein, the invention is susceptible of embodiment in many different forms and it should be understood that the present disclosure is to be considered as an exemplification of the principles of the invention and is not intended to limit the invention to the embodiment illustrated.

BRIEF DESCRIPTION OF THE DRAWINGS

FIGS. 1A and 1B together comprise a single block and schematic diagram of the electronic musical synthesizer having a variable/preset voice control.

GENERAL OPERATION OF SYNTHESIZER

Figure 1A:
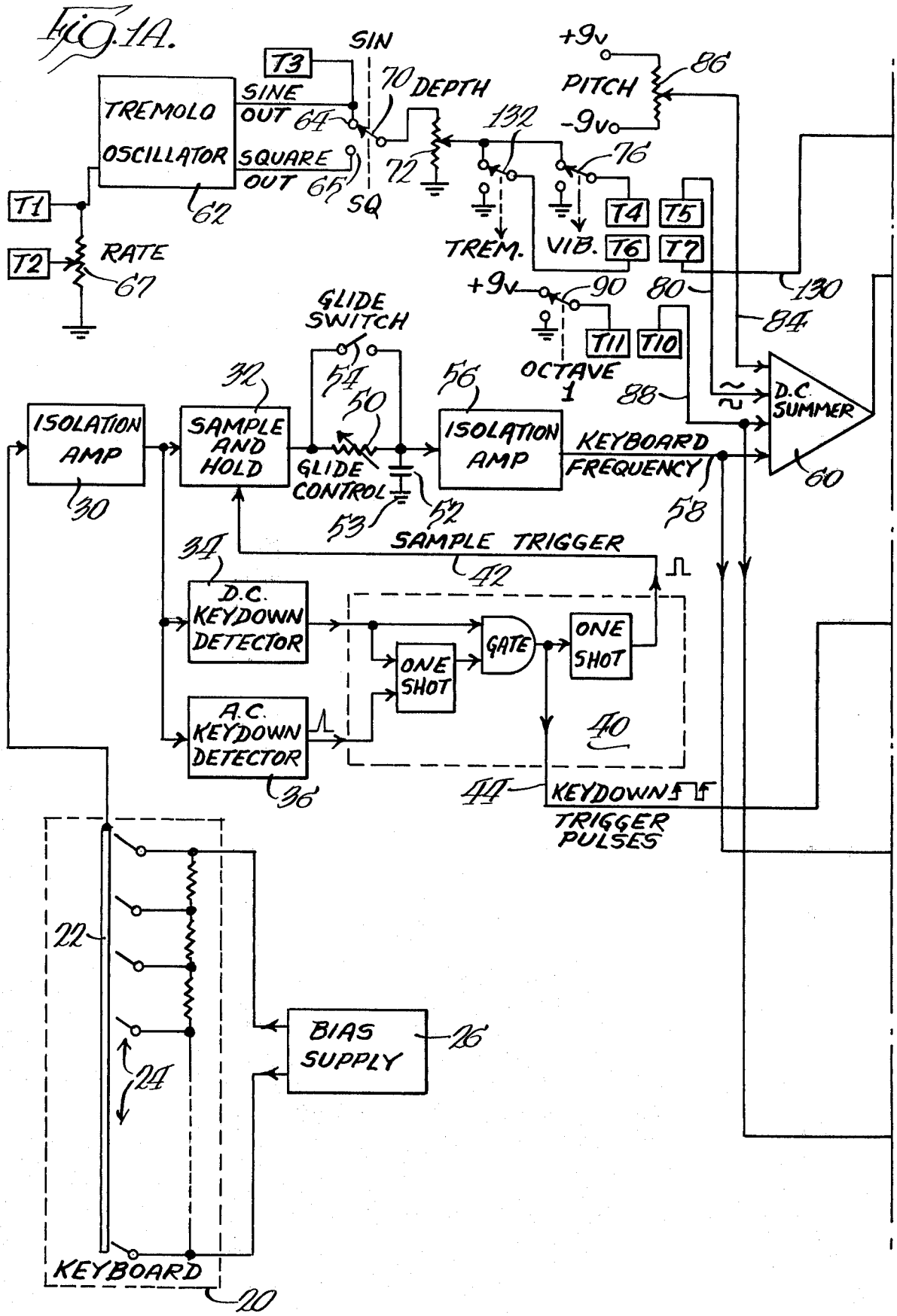

Turning to FIGS. 1A and 1B, tone signals are generated by a conventional 44 note keyboard 20 which produces in a keying member 22 a DC voltage proportional to the particular depressed key 24. All of the keys are coupled between series resistors connected across a DC bias supply 26. A voltage representing the depressed key is coupled through an isolation amplifier 30 to a sample and hold circuit 32, and to a DC keydown detector 34 and an AC keydown detector 36. A keydown detector circuit 40, of conventional design, generates on a sample trigger line 42 an AC pulse which occurs each time another key 24 is depressed. On a trigger line 44, a keydown trigger pulse is generated having a leading edge each time a key 24 is first depressed.

Because the electronic synthesizer of the present embodiment is a monophonic instrument with a high note preference, the AC keydown detector 36 is used to detect when another key, other than the one which is being held down continuously, is being depressed. The keydown detector 40 includes a one-shot multivibrator, having a 15 millisecond delay time, to prevent generation of a keydown trigger pulse due to noise or contact bounce. Whenever a signal persists for more than 15 milliseconds, circuit 40 enables the sample and hold circuit 32 in order to capture the DC keying voltage then being coupled through isolation amplifier 30, and holds this DC keying voltage for a predetermined time period such as about 1 minute. While the synthesizer is illustrated as a monophonic instrument, as is conventional, it will be appreciated that plural tone branches could be provided, similar to an electronic organ, in order to allow simultaneous generation of plural musical notes.

The DC keying voltage is transferred through a glide control variable resistor 50 and integrating capacitor 52, coupled to a source of reference potential or ground 53. The RC integrator may be bypassed by a glide switch 54 to directly couple the keying voltage to an isolation amplifier 56. The amplifier 56 generates on a keyboard frequency line 58, a DC voltage representative of the output of the sample and hold circuit 32. If the glide switch 54 is opened, inserting in circuit the RC glide network, the envelope of the DC keying voltage is altered to produce a musical portamento effect something like that produced in a Hawaiian guitar.

The keyboard frequency voltage on line 58 is coupled to a DC summer amplifier 60 which has auxiliary voltage inputs which add to, or modulate, the keyboard frequency signal. A tremolo oscillator 62 generates a sine wave output, coupled to a terminal 64, and a square wave output, coupled to a terminal 65, at a rate or frequency which is controlled by a rate variable resistor 67. An operator selectable sine/sq switch 70 allows the operator to select either the sine wave or the square wave for routing through a depth potentiometer 72, which adjusts the amplitude or depth of the alternating modulation signal from the tremolo oscillator 62. The modulation signal is routed through a tremolo channel, to be explained later, and a vibrato channel.

The vibrato channel includes a vibrator (vib) switch 76 which is normally coupled through terminals T4 and T5 to vibrato input 80 for the DC summer 60. When the operator desires to add vibrato to the tone, the vib switch 76 is moved to the illustrated position in order to effectively couple the wiper of potentiometer 72 to vibrato input 80.

All of the terminals T, illustrated within a rectangular box and followed by an identifying number 1 through 13, are connected to corresponding terminals T from a preset synthesis module 82, FIG. 1B, which forms a part of the present invention. During a variable mode, the module 82 shunts certain of the terminals T to allow a conventional type operation of the synthesizer. During a preset mode, the module 82 effectively removes certain adjustable controls from the circuit, and presets control voltages so as to duplicate within the ability of the synthesizer, one of several well-known musical instruments as well as to produce several distinctively synthesizer type sounds. For the present discussion of the general operation of the synthesizer, the connection which produces a conventional operation will be described.

DC summer 60 also has a pitch input 84 from a potentiometer 86 which is adjustable to vary the pitch, i.e. to fine tune the instrument. An octave 1 input 88 (FIG. 1A) is normally coupled through shunted terminals T10 and T11 to an Octave 1 switch 90. When switch 90 grounds input 88, the synthesizer produces a tone within the highest octave of the instrument. The note is lowered by one octave, to Octave 1, by moving switch 90 to the illustrated position which couples +9 volts to input 88. As will be explained, a still lower octave, Octave 2, is available by another control to be described later.

All voltages applied to the inputs of the DC summer 60 are scaled and added together in order to generate a DC tone signal which is coupled to a voltage controlled oscillator 100. The oscillator generates a sawtooth waveform which is coupled to a waveform selector 102. The frequency of the sawtooth waveform is directly proportional to the DC voltage from the DC summer 60. The oscillator 100 will lower the frequency output by one octave, to Octave 2, when nine volts is present on an Octave 2 line 104. Line 104 is normally coupled through shunted terminals T9 and T8 to an Octave 2 switch 106.

Waveform selector 102 is conventional and processes the sawtooth wave in order to generate one of several conventional outputs. The output waveform is first a sawtooth, then changes to a narrow rectangular wave, then to broad rectangular, and finally to a square wave as controlled by the DC voltage on a waveform selection input 110. The control voltage on input 110 is generated by part of a resistor matrix 112.

Resistor matrix 112 has twelve vertical output lines. Fifteen horizontal lines, coupled to terminals TA through TO, carry voltages of either +9 volts DC, or zero volts DC (ground). Each horizontal line may be coupled through a resistor of preselected value to a vertical line, or may not be coupled by omitting the resistor. The first two horizontal rows TA and TB carry voltages corresponding to selection of Octave 2 or Octave 1, respectively. The remaining horizontal rows TC through TO carry voltages generated by the preset synthesis module 82. As will be explained, the portion of module 82 dedicated to the generation of voltages coupled to terminals TC through TO is conventional.

Waveform selection input 110 is coupled to predetermined matrix resistors, as for example a resistor 114 which connects with the horizontal line coupled to terminal TO. As will be apparent later, terminal TO carries +9 volts thereon only when all voice switches are off, indicating a flute voice. When such a voice is to be produced, terminal TO carries +9 volts thereon, which voltage is dropped by resistor 114 to produce on input 110 a voltage which preselects the desired flute waveform.

The selected waveform is coupled to a voltage controlled bandpass filter 120. The bandwidth or Q of filter 120 is controlled by a bandwidth input 122 coupled to the wiper of an emphasis potentiometer 124. The fixed resistance portion is coupled across terminals T12 and T13, and when these terminals are coupled by module 82 to −9 and +9 volts, respectively, the wiper may be varied from its center position in order to vary the bandwidth or emphasis of the synthesizer. Bandwidth input 122 is also coupled to the resistor matrix 112 for selective coupling to predetermined voltages when certain instruments are to be simulated.

The center frequency of bandpass filter 120 is controlled by the voltage on a center frequency input 126, which has several sources of signals. A resistor 128 couples input 126 to a tremolo input 130 which is normally coupled through shunted terminals T6 and T7 to the tremolo channel associated with the oscillator 62. Namely, terminal T6 is coupled to a switch 132 which, in the illustrated position, couples input 130 to the wiper of the depth potentiometer 72. When switch 132 is in the tremolo position and module 82 is shunting terminals T6 and T7, the modulating signal is coupled via input 130 and resistor 128 to the center frequency input 126, thereby cyclically varying the center frequency of the bandpass filter 120.

Center frequency input 126 is also coupled through a resistor 134 to the wiper of a color potentiometer 136. The end terminals of potentiometer 136 are coupled to the same terminals T12 and T13 as is the emphasis potentiometer 124. When module 82 couples equal and opposite bias potentials across these terminals, the wiper of color potentiometer 136 can be adjusted away from center to vary the center frequency of the bandpass filter 120.

Center frequency input 126 is also coupled to a vertical line 140 in the resistor matrix 112, and to an analog gate 142 which normally passes the keyboard pitch voltage available on line 58. A vertical gating line 144 in the resistor matrix determines, by the presence or absence of potential thereon, whether or not analog gate 142 will pass the pitch voltage to the input 126.

Center frequency input 126 is also coupled to an output line 148 of an electronic switch 150. The electronic switch is a two position switch which couples the output of a filter contour envelope generator 152 to either output 148, or to an output 154, depending on the presence or absence of a control voltage on a vertical control line 156 which forms a part of the resistor matrix 112. For any one selected instrument, electronic switch 150 is maintained in either one or the other of its two states, and does not change state until a different instrument is selected which changes the potential on vertical control line 156.

When electronic switch 150 couples output 148 to the output of the envelope generator 152, the center frequency of bandpass filter 120 varies during the attack and decay period of each generated tone. The keyboard pitch voltage on line 58 is coupled through resistors 160 and 162 to the decay rate input 164 and the attack rate input 166, respectively, of envelope generator 152. The envelope generator is conventional and changes the attack and decay rate, by a factor of about 2½, over the complete keyboard range as determined by the pitch voltage coupled by the resistors 160 and 162. Two types of filter contours are available, as controlled by a piano/organ envelope control line 168 which forms a part of the resistor matrix. When the voltage on line 168 is in one state, the filter contour will rise and then immediately fall. When the control voltage on line 168 is in the other state, the filter contour will rise and then fall only upon release of all key switches, as indicated by the keydown trigger pulse on line 44 which forms another input to the envelope generator 152.

Manual adjustment over the attack and decay rates is controllable by a contour potentiometer 170 having a wiper coupled through resistors 172 and 174 to the decay rate input 164 and attack rate input 166, respectively. The ends of contour potentiometer 170 are coupled to the same terminals T12 and T13 as are the emphasis potentiometer 124 and color potentiometer 136. When module 82 couples these terminals across equal and opposite bias sources, the wiper can be moved off of its center position to increase or decrease the attack and decay rate for the tone. The various inputs for controlling the attack and decay rate of the tone, when routed by electronic switch 150 to the center frequency input 126, change the tuning of the filter during the progression of the tone, so that the sound emitted is different for different points in time during sounding of a single tone. As previously noted, this is characteristic of an electronic synthesizer as distinguished from an electronic organ.

The frequency modified tone from bandpass filter 120 is coupled to a voltage controlled low-pass filter 180, having a control input 182 for varying the cut-off frequency of the low-pass filter. The low-pass filter provides additional cut-off control for frequencies passed by the bandpass filter. The cut-off frequency input 182 is coupled through a resistor 184 to the tremolo modulating signal on line 130. Input 182 is also coupled through resistor 186 to the wiper of the color potentiometer 136. Input 182 is also coupled to the output 154 of electronic switch 150, in order to route the attack/decay control signals from the filter contour envelope generator 152 to the low-pass filter. Finally, the input 182 is coupled to a vertical line 190 which forms a part of the resistor matrix 112. It will be noted that many of the same signals which control the center frequency of the bandpass filter also control the cut-off frequency of the low-pass filter, in order to vary the frequency characteristics of the modified tone signal which is being processed. Control over the attack and decay rates of the low-pass filter is provided when electronic switch 150 couples the filter contour envelope generator 152 to the line 154, under control of an appropriate control voltage on vertical line 156.

The frequency modified tone from the low-pass filter 180 is coupled to a modulator 194 which basically is a variable gain amplifier. The gain of the modulator 194 is controlled by an AM envelope input 196 which is coupled to an amplitude envelope generator 198. The amplitude envelope generator 198 is generally similar to filter contour envelope generator 152, and includes a decay rate input 200, an attack rate input 202, and a piano/organ envelope input 204. All of the inputs 200, 202 and 204 correspond in function with the similar inputs 164, 166 and 168, respectively, of the envelope generator 152. The decay rate input 200 and attack rate input 202 are coupled through resistors 206 and 208, respectively, to the tone voltage on line 58.

The amplitude envelope generator 198 also has an input coupled to the keydown trigger line 44 for use when the filter contour is to rise and then fall only upon release of all keys. A sustain switch 210 is provided to control the amplitude in accordance with whether the sustain function has been selected. The decay time of an envelope is generally longer than the attack time. As the input 200 indicates a longer decay time, the decay slope is processed to have an extended tail in order to sound like more natural exponential decay. When the sustain tab 210 is up and the keys are released, the tone is squelched rapidly. Similar to envelope generator 152, the envelope generator 198 changes the amplitude attack and decay times by a factor of over 2½ times for the complete keyboard range.

The variable gain modulator 194 also has a master volume variable resistor 214 for overall control of the gain of the voice before the voice is then coupled to an output stage 216 including a loudspeaker 218 for audio reproduction of the voice signal.

Except for the preset synthesis module 82 and the interconnections made by terminals T1 through T13, the synthesizer shown in FIGS. 1A and 1B is conventional and various modifications may be made as will be apparent to those skilled in the art. In the following section, the interconnections produced by module 82, and the resulting changed operation of the synthesizer, will be described in detail.

PRESET SYNTHESIS MODULE

Figure 2:
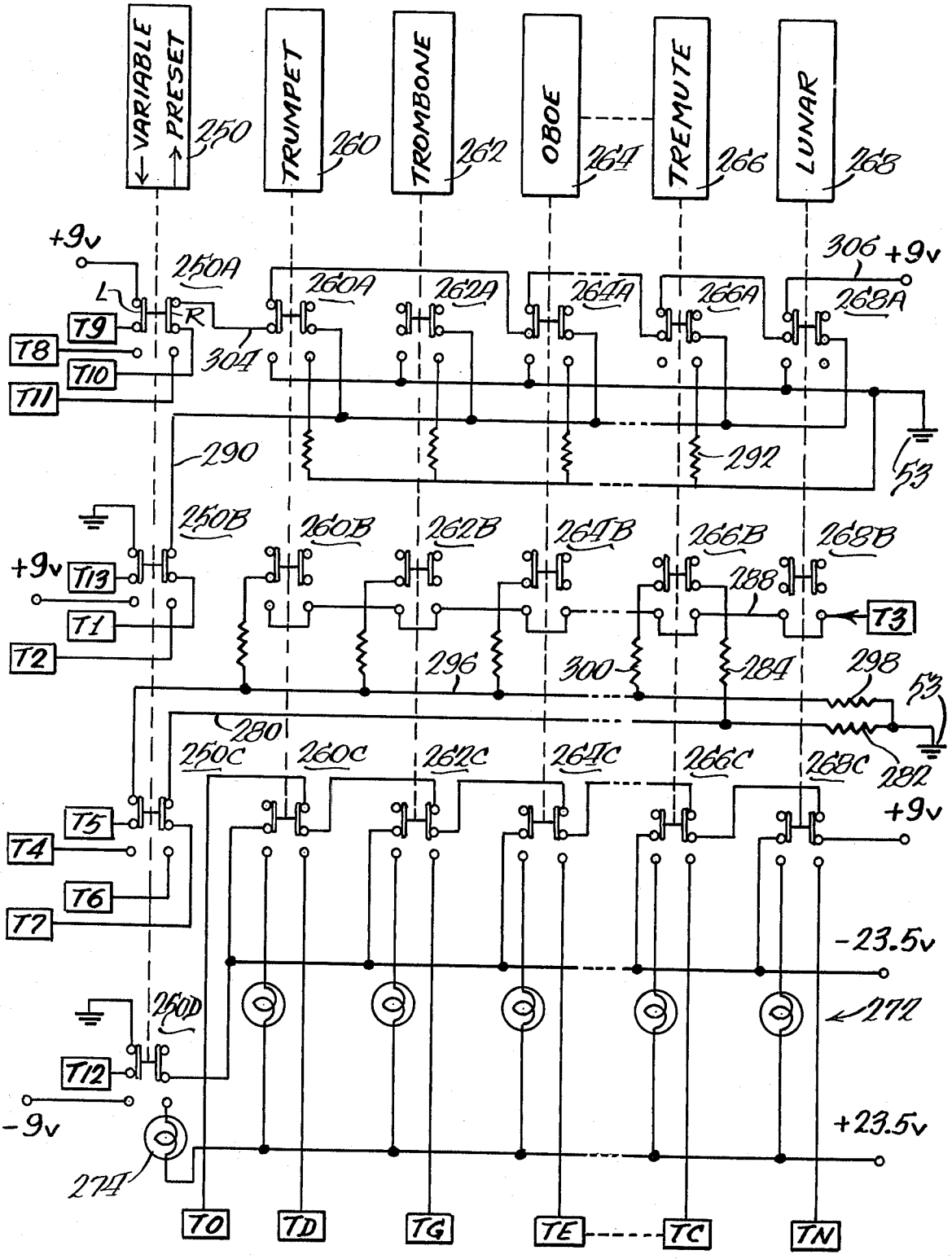
FIG. 2 is a schematic diagram of the preset synthesis module in block form in FIG. 1B.

The preset synthesis module 82, shown in block form in FIG. 1B is illustrated in detail in FIG. 2. The terminals T for interconnecting the module 82 in the circuits of FIGS. 1A and 1B are illustrated within the rectangular boxes labeled T. Module 82 includes a variable/preset switch 250 having four ganged switch sections labeled 250A, 250B, 250C and 250D. The external tab for operator selection which has been labeled 250, can be moved upward (as illustrated in FIG. 2) to establish a preset state, or downward to establish a variable state.

Each switch section, for switch 250 as well as the other switches shown in FIG. 2, is comprised of two electrically independent contact bars, hereinafter arbitrarily designated L for left and R for right, as viewed in FIG. 2. For clarity, only the contact bar L and contact bar R for switch section 250A are labeled in FIG. 2, it being understood that all of the remaining switch sections will be identified following this convention. The contact bars L and R are mechanically ganged for movement with the associated switch tab, and have either an up or down state. In the up state, the pair of independent center terminals are coupled through the L and R contact bars to the upper terminals located immediately thereabove. In the down state, the pair of center terminals are coupled to the pair of lower terminals.

In addition to switch 250, a plurality of selectable voice networks or voice switches are provided, as represented by a trumpet switch 260, a trombone switch 262, an oboe switch 264, a tremute switch 266, and a lunar switch 268. Each voice switch has three ganged switch sections, consisting of auxiliary sections A and B and a preset section C. Each switch section is comprised of an L contact bar and an R contact bar, following the convention already described.

For clarity, only five voice switches have been illustrated, but it will be appreciated that a large number of additional voice switches may be provided as indicated by dashed lines between the oboe switch 264 and the tremute switch 266. The tab switching circuits for the additional voice switches would be interconnected in generally the same manner as represented by the illustrated tab switches. By way of example, additional voice switches might be provided for clarinet, sax, cello, harpsicord, guitar, banjo and pizzicatto, having preset sections connected with terminals TF, TH, TI, TJ, TK, TL and TM, respectively. The voice switches are activated by depression of the associated tab. In FIG. 2, none of the voice switches have been selected. Upon depression of any voice switch tab, the three sections ganged thereto would be activated so as to interconnect the middle switch contacts with the lowermost switch contacts.

Voice switch sections C form preset sections which control switching of +9 volts to selected ones of the horizontal lines in the resistor matrix 112, and per se are conventional. The R contact bars associated with each voice section C controls whether +9 volts is to be passed to a corresponding terminal TC through TN. When no voice switches are depressed, a +9 volt signal is conveyed through all of the R contact bars and interconnected upper and middle contacts to terminal TO, thereby energizing the last horizontal line in the resistor matrix. This line represents a flute, and is selected when all the voice tabs are in the off position. The L contact bars for the voice switch sections C control energization of an indicator lamp 272 which is individually associated with each switch section.

For example, if the operator wishes to select a trumpet voice, tab 260 is depressed to cause the L and R bars of section 260C to interconnect the center contacts with the two lowermost contacts. The R bar for 260C passes +9 volts to terminal TD, thereby causing +9 volts to appear on horizontal line TD shown in FIG. 1B. The resistors interconnecting horizontal line TD with certain of the vertical control lines pass control voltages (or no control voltage) to the envelope generators, bandpass and low-pass filters, and waveform selector, in a manner to simulate a trumpet voice. At the same time, the L bar for 260C passes −23.5 volts, to the indicator lamp 272 located directly below section 260C. The indicator lamps are located on a console in close proximity to the voice tabs, or could be combined to form lit push-button tab switches. In prior voice switching circuits, only the C sections of the voice switches have been provided, and not the auxiliary A and B sections to be described later.

Variable/preset switch 250 controls the voltages coupled to or from terminals T1-T13. When tab 250 is depressed to select the variable state, the circuits of FIGS. 1A and 1B are connected in a conventional manner. That is, contact bar L of section 250D connects terminal T12 to −9 volts, and contact bar L of section 250B connects terminal T13 to +9 volts. As seen in FIG. 1B, this couples equal and opposite bias voltages across all of the fixed resistors for emphasis potentiometer 124, color potentiometer 136 and contour potentiometer 170. Thus, the frequency characteristics of the filters 120 and 180 can be manually varied within ranges having center conditions preset by the resistor matrix 112, as controlled by control voltages generated from the C section of a selected voice switch.

In addition, the variable state of switch 250 causes the tremolo oscillator 62 of FIG. 1A to be rendered effective for manual adjustment. Contact bar R of section 250B shunts terminals T1 and T2, causing the rate control 67 to operate as a variable resistor. Also, section 250C causes terminals T4 and T5 to be shunted together, and terminals T6 and T7 to be shunted together, thereby rendering effective the vibrato channel and its switch 76, and the tremolo channel and its switch 132 both of which are connected to depth potentiometer 72 which is thus also rendered effective. Contact bar R of section 250A shunts terminals T10 and T11, rendering effective the octave 1 switch 90, and contact bar L of the same section shunts together terminals T8 and T9, thereby rendering effective the octave 2 switch 106. Finally, contact bar R of section 250D couples the upper side of variable state indicator lamp 274 across a bias so as to visually indicate that switch 250 is in the variable state. Thus, all adjustable controls which have previously been provided for a synthesizer are rendered effective by the variable state of switch 250.

When variable/preset switch 250 is moved to the preset state, the adjustable controls for changing the frequency characteristics of the electrical filters, and for changing the octave and for controlling vibrato, are effectively disabled and only preset control voltages are generated. Contact bars L of sections 250D and 250B ground terminals T12 and T13, thereby effectively removing the emphasis potentiometer 124, the color potentiometer 136 and the contour potentiometer 170 from the circuit of FIG. 1B. As a result, the bandwidth and center frequency of bandpass filter 120, the cut-off frequency of low-pass filter 180, and the attack and decay contour rates for the bandpass filter and the low-pass filter are controlled solely by the resistor matrix 112. Since the resistors in resistor matrix 112 are selected by the voice switches and generate control voltages which establish the best voice reproduction which can be produced by the synthesizer, the operator does not need to recenter the control potentiometers. Also, mechanical offsets in the linkages for the control potentiometers will not cause a modified voice to be produced.

The preset state also establishes preset conditions for the tremolo and vibrato channels of the synthesizer. Contact bar R of section 250C now breaks the connection between terminals T6 and T7, thereby rendering ineffective the tremolo switch 132. In addition, the tremolo input 130 is now coupled via terminal T7 and contact bar R of section 250C to a line 280 which has its end coupled through a resistor 282 to ground. Line 280 is coupled by preselected resistors to the center terminals of voice switch sections B in order to establish a preset tremolo effect for a selected voice. For example, a resistor 284 connects line 280 to the center terminal associated with contact bar R of switch section 266B. When the operator selects a tremute voice by depressing voice tab 266, contact bar R of 266B connects resistor 284 to a line 288 connected to terminal T3. As seen in FIG. 1A, terminal T3, directly receives a sinusoidal modulating signal from the tremolo oscillator 62. Thus, the sinusoidal modulating signal is coupled through voice switch section 266B and resistor 284 to terminal T7 of the tremolo channel. Resistor 284 performs the function of the depth potentiometer 72, and thus presets the depth or amplitude of the modulating signal which is passed to the tremolo channel.

Also, the frequency or rate for the tremolo oscillator is controlled by a preset control voltage. Contact bar R of section 250B disconnects terminals T1 and T2, which previously had allowed the rate potentiometer 67 to control the frequency of the tremolo oscillator 62. Terminal T1 is now coupled by said bar R to the upper contact, connected with a line 290 which is coupled to the center terminal of the right portion of each of the voice switch sections A. Assuming that the tremute tab 266 had been selected, contact bar R of section 266A now connects line 290 through a resistor 292 to ground. The value of resistor 292 is selected, when connected in parallel with the fixed resistance portion of potentiometer 67, to establish a preset resistance which presets the frequency of tremolo oscillator 62 as desired for the selected tremute voice.

Vibrato is controlled by contact bar L of section 250C. In the preset mode, terminal T5 is coupled to a line 296 having one end coupled through a resistor 298 to ground. For each voice which is to have a preset vibrato effect, a resistor connects line 296 to the center left contact of the associated voice switch section B. For example, a resistor 300 is connected ass indicated above so that when the tremute tab 266 is depressed, contact bar L of section 266B causes resistor 300 to be coupled to the sinusoidal modulating input line 288 (connected to terminal T3). The resistor 300 has a value to preselect the depth of the modulating signal coupled to terminal T5 of the vibrato channel. The resistor 300 thus serves the purpose of the depth potentiometer 72.

Finally, the preset state also presets the octave controls. Contact bar L of section 250A, when in the preset state, disconnects terminals T8 and T9 and causes terminal T9 to be directly coupled to +9 volts. Contact bar R of section 250A also disconnects terminals T10 and T11 and connects terminal T10 to a line 304 which is interconnected with some of the L contact bars of the voice switch sections A. This connects or disconnects line 304 from +9 volts, available on a line 306, depending on the voice tab which has been depressed. For example, if the tremute tab 266 is selected, contact bar L of section 266A breaks the series connection, preventing +9 volts from being coupled to terminal T10 which is in turn directly coupled to the octave 1 input 88 of the DC summer amplifier 60. If, for example, the trombone tab 262 had been depressed, the series connection would not have been broken, since the L bar of trombone switch section 262A is not connected in the series path between line 306 and line 304. Thus, the octave for the selected voice is preset, and the octave switches are disabled during the preset state.

While certain voice switches have been illustrated as producing particular preset conditions for the synthesizer, it will be appreciated that the several preset conditions can be changed as desired, in order to produce a wide variety of effects. Additional voices can be provided, if desired. Other changes and modifications will be apparent from the above teachings.

Having described the invention, the embodiments of the invention in which an exclusive property or privilege is claimed are defined as follows:

1. In an electronic musical synthesizer having a source of tone signals processed by a controllable filter having a variable frequency characteristic adjustable under control of a control signal, the improvement comprising:

variable means coupled to the controllable filter for generating a variable control signal which is adjustable to alter the frequency characteristic of the filter;

preset means coupled to the controllable filter for generating a preset control signal which produces a fixed frequency characteristic for the filter;

switching means having a preset state; and circuit means responsive to the preset state of the switch for effectively disabling the variable means and enabling the preset means to cause the filter frequency characteristic to be controlled solely by the preset means.

2. The improvement of claim 1 wherein the controllable filter comprises a bandpass filter having a variable bandwidth corresponding to said frequency characteristic and controllable by a variable voltage at a bandwidth input, the variable means comprises an emphasis potentiometer for changing the bandwidth of the bandpass filter, a bias source connectable with the emphasis potentiometer to generate a variable voltage coupled to the bandwidth input, and wherein the circuit means is responsive to a variable state of the switch for connecting the bias source to the emphasis potentiometer and is responsive to the preset state for disconnecting the emphasis potentiometer from the bias source.

3. The improvement of claim 1 wherein the controllable filter comprises in series a bandpass filter and a low-pass filter, the center frequency of the bandpass filter being variable by a first voltage coupled to a center frequency input thereof, the cut-off frequency of the low-pass filter being variable by a second voltage coupled to a cut-off frequency input thereof, the center frequency and the cut-off frequency corresponding to said frequency characteristic, and wherein the variable means comprises a color potentiometer having a first impedance path coupled to the center frequency input and a second impedance path coupled to the cut-off frequency input, a bias source coupleable to the color potentiometer to generate first and second voltages in the first and second impedance paths, respectively, and the circuit means being responsive to a variable state of the switch to couple the bias source to the color potentiometer and responsive to the preset state for disconnecting the bias source from the color potentiometer.

4. The improvement of claim 1 including a filter contour envelope generator connectable to the controllable filter for generating a contour control signal having a variable attack rate controllable by a first voltage at an attack rate input and a variable decay rate controllable by a second voltage at a decay rate input, the variable means comprises a contour potentiometer for changing the rate of change of timbre, a first impedance path for coupling the contour potentiometer to the attack rate input, a second impedance path for coupling the contour potentiometer to the decay rate input, a bias source coupleable with the contour potentiometer to produce first and second voltages in the first and second impedance paths, respectively, and the circuit means being responsive to a variable state of the switch for coupling the bias source to the contour potentiometer and responsive to the preset state for disconnecting the bias source from the contour potentiometer.

5. The improvement of claim 4 wherein the controllable filter comprises a bandpass filter having a variable center frequency under control of the contour control signal at a control input, and means connecting the filter contour envelope generator to the control input whereby the contour potentiometer controls the center frequency attack rate and decay rate during the variable state.

6. The improvement of claim 4 wherein the controllable filter comprises a low-pass filter having a variable cut-off frequency under control of the contour control signal at a control input, and means connecting the filter contour envelope generator to the control input whereby the contour potentiometer controls the cut-off frequency attack rate and decay rate during the variable state.

7. In an electronic musical instrument having a source of tone signal, an oscillator for generating a modulation signal continuously variable under control of a variable impedance, a vibrato switch, and combining means coupled to the source and coupled by the vibrato switch to the oscillator for superimposing the modulation signal on the tone signal and to modulate the tone signal with a vibrato, the improvement comprising:

preset means effective when coupled to the oscillator for producing a preset modulation signal;

a control switch having a preset state; and a control circuit responsive to the preset state for effectively substituting the preset means for the variable impedance to produce a preset vibrato modulation in the tone signal.

8. The improvement of claim 7, wherein the variable impedance includes a rate variable impedance for varying the frequency of the modulating signal and a depth variable impedance for varying the amplitude of the modulating signal, the preset means comprises a rate network effective for establishing a preset frequency for the modulating signal and a depth network effective for establishing a preset amplitude for the modulating signal, the control circuit being responsive to the preset state for substituting the rate network for the rate variable impedance and the depth network for the depth variable impedance.

9. The improvement of claim 7 including a plurality of voice switches selectable to modify the tone signal to produce a selected voice, each voice switch having a preset section effective to change the voice and an auxiliary section, and a plurality of preset means each coupled to the auxiliary section of a voice switch for establishing a preset modulation signal controlled by the selected voice switch, the control circuit includes an auxiliary circuit responsive to the auxiliary section of a selected voice switch when the associated auxiliary section is enabled by selection of the corresponding voice switch.

10. The improvement of claim 7 wherein the electronic musical instrument comprises a synthesizer having a controllable filter for processing the tone signal, the controllable filter having a control input responsive to a voltage for varying a frequency characteristic of the filter, voice selection means coupled to the control input for producing selected voltages in accordance with selected voices to be produced by the synthesizer and including the variable impedance for generating a variable voltage to alter the frequency characteristic of the filter, the control circuit being responsive to the preset state for effectively disabling the variable impedance to prevent adjustment of the selected voice.

11. In an electronic musical synthesizer having a source of tone signals processed by a controllable filter having a variable frequency characteristic adjustable under control of a control signal, the improvement comprising:

variable means coupled to the controllable filter for generating a variable control signal which is adjustable to alter the frequency characteristic of the filter;

a plurality of voice networks coupled to the controllable filter and each selectable to generate at least one particular preset control signal which imitates a particular voice by producing a fixed frequency characteristic for the filter;

switch means having a preset state and a variable state;

circuit means responsive to the variable state of the switch means for causing both the particular preset control signal from a selected voice network and the variable control signal to be coupled to the controllable filter and responsive to the preset state of the switch means for effectively disabling the variable means and enabling the plurality of voice networks to cause the filter frequency characteristic to be controlled solely by the selected voice network.

12. The improvement of claim 11 wherein at least one of the plurality of voice networks includes an auxiliary section for generating an auxiliary signal in addition to the preset control signal, the circuit means being responsive to the preset state for causing the auxiliary signal to alter the selected voice.

13. The improvement of claim 12 wherein the source includes an oscillator for generating a modulating tone signal which modulates a primary tone signal, the auxiliary section presetting the oscillator to produce a preset modulating tone signal which corresponds to the auxiliary signal.

14. The improvement of claim 12 wherein the source includes octave means for generating an octave signal for changing the octave of a primary tone signal when combined therewith to produce a voice tone signal processed by the controllable filter, the auxiliary section causing the octave means to be preset to generate a preset octave signal which corresponds to the auxiliary signal and fixes the octave of the primary tone signal.

15. The improvement of claim 11 wherein the controllable filter has a control input responsive to a voltage for varying the frequency characteristic of the filter, the variable means includes a variable impedance coupled to a bias source for generating a variable voltage coupled to the control input, the circuit means being responsive to the variable state of the switch for coupling the variable voltage and the preset control signal of the selected voice network to the control input, the variable impedance being used in common with each of the voice networks when enabled.

16. In an electronic musical synthesizer having a keyboard for generating a plurality of tone signals coupled to a channel for processing the tone signals into voice signals, the channel including a controllable filter having a variable frequency characteristic controllable by a variable control signal, the improvement comprising:

a plurality of individually selectable voice switches each having a preset section and an auxiliary section;

a voice preset circuit for coupling the preset section of a selected one of the plurality of voice switches to the controllable filter to generate a preset control signal which produces a selected voice signal different from other selectable voice signals produced for the same tone signal;

adjustable means for generating an adjustable auxiliary signal for variable auxiliary control over the voice produced by the channel;

an auxiliary circuit coupled to the auxiliary section of a selected one of the plurality of voice switches for generating a preset auxiliary signal for preset auxiliary control over the voice produced by the channel;

a control switch having a variable state and a preset state; and a control circuit responsive to the variable state for connecting the adjustable means to the channel and responsive to the preset state for connecting the auxiliary circuit to the channel.

17. The improvement of claim 16 wherein the channel includes an oscillator for generating a modulating signal which corresponds to the auxiliary signal, the adjustable means comprises an adjustable control for varying the frequency or amplitude of the modulating signal, and the auxiliary circuit includes a preset control for fixing the frequency or amplitude of the modulating signal.

18. The improvement of claim 17 wherein the channel includes a summer for combining the modulating signal with the tone signal, a vibrato switch for connecting the oscillator to the summer when the control switch is in the variable state, and the control circuit is responsive to the preset state for bypassing the modulating signal to the summer when the auxiliary section of the selected voice switch establishes that the selected voice is to be accompanied by vibrato.

19. The improvement of claim 17 wherein the channel includes a tremolo switch for connecting the oscillator to the controllable filter when the control switch is in the variable state to cause the modulating signal to modulate the frequency characteristic of the filter, and the control circuit is responsive to the preset state for bypassing the modulating signal to the controllable filter when the auxiliary section of the selected voice switch establishes that the selected voice is to have a tremolo change of spectrum.

20. The improvement of claim 16 wherein the channel includes an octave switch effective during the variable state for changing the frequency of the tone signal by an octave, the control circuit being responsive to the preset state for bypassing the octave switch to change the frequency of the tone signal by an octave when the auxiliary section of the selected voice switch indicates that the voice is to have an octave change.

21. The improvement of claim 16 wherein the channel includes a variable impedance for generating an adjustable control signal which alters the frequency characteristic of the controllable filter within a range containing the frequency characteristic established by the voice preset circuit, and the control circuit is responsive to the preset state for effectively disabling the variable impedance to cause the frequency characteristic to be controlled solely by the preset section of the selected voice switch.

22. The improvement of claim 21 wherein the channel includes a bias source effective when coupled to the variable impedance for generating a supplemental control signal, the control circuit being responsive to the variable state for connecting the bias source to the variable impedance.

* * * * *

UNITED STATES PATENT OFFICE
CERTIFICATE OF CORRECTION

Patent No. 3,948,139 Dated April 6, 1976

Inventor(s) Byron Melcher et al

It is certified that error appears in the above-identified patent and that said Letters Patent are hereby corrected as shown below:

On the Cover Sheet cancel Figure of drawing and substitute attached Figure.

Signed and Sealed this

Twentieth Day of July 1976

[SEAL]

*Attest:*

RUTH C. MASON
*Attesting Officer*

C. MARSHALL DANN
*Commissioner of Patents and Trademarks*

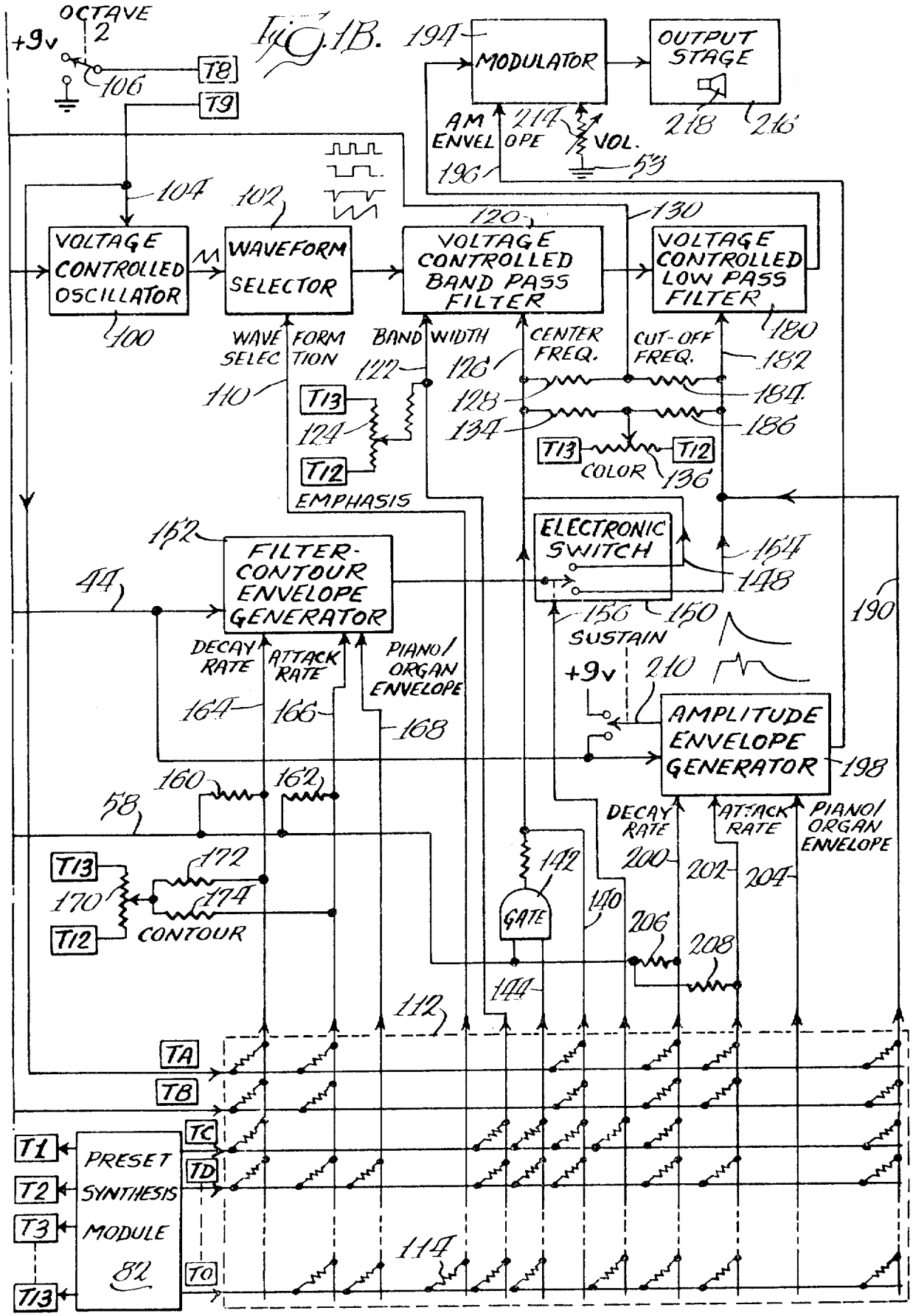
Fig. 1B.
OCTAVE
2
+9v
106
T8
T9
194
MODULATOR
OUTPUT STAGE
AM ENVELOPE
214
VOL.
53
218
216
196
104
102
120
130
VOLTAGE CONTROLLED OSCILLATOR
WAVEFORM SELECTOR
VOLTAGE CONTROLLED BAND PASS FILTER
VOLTAGE CONTROLLED LOW PASS FILTER
100
180
WAVE SELECTION
BAND WIDTH
CENTER FREQ.
CUT-OFF FREQ.
182
110
122
126
128
184
134
186
T13
124
T12
EMPHASIS
COLOR
136
152
FILTER-CONTOUR ENVELOPE GENERATOR
ELECTRONIC SWITCH
154
148
44
156
150
190
SUSTAIN
DECAY RATE
ATTACK RATE
PIANO/ ORGAN ENVELOPE
+9v
210
164
166
168
AMPLITUDE ENVELOPE GENERATOR
198
160
162
58
DECAY RATE
ATTACK RATE
PIANO/ ORGAN ENVELOPE
200
202
204
T13
172
170
174
T12
CONTOUR
142
GATE
140
206
208
144
112
TA
TB
TC
TD
T1
T2
T3
T13
PRESET SYNTHESIS MODULE
82
TO
114